United States Patent [19]

Vestal, Sr.

[11] Patent Number: 4,892,088

[45] Date of Patent: Jan. 9, 1990

[54] FIREPLACE GRATE

[75] Inventor: David M. Vestal, Sr., Sweetwater, Tenn.

[73] Assignee: Vestal Manufacturing Company, Sweetwater, Tenn.

[21] Appl. No.: 365,370

[22] Filed: Jun. 13, 1989

[51] Int. Cl.[4] ..... F23H 13/00

[52] U.S. Cl. ..... 126/540; 126/152 R

[58] Field of Search ..... 126/540, 152 R, 152 B; 108/53.3; 206/499

[56] References Cited

U.S. PATENT DOCUMENTS

| | | | |
|---|---|---|---|
| 2,903,218 | 9/1959 | Altenburg | 108/53.3 |
| 3,630,157 | 12/1971 | Ortenblad | 108/53.3 |
| 4,428,306 | 1/1984 | Dresen et al. | 108/53.3 |

FOREIGN PATENT DOCUMENTS

| | | | |
|---|---|---|---|
| 1792 | 1/1899 | United Kingdom | 126/152 R |
| 674374 | 6/1952 | United Kingdom | 126/540 |

*Primary Examiner*—Carroll B. Dority

*Attorney, Agent, or Firm*—Luedeka, Hodges & Neely

[57] ABSTRACT

A fireplace grate including a ribbed framework providing a support surface for fireplace fuels and a plurality of legs for supporting the framework above a fireplace floor utilizes a plurality of recesses disposed across the support surface which each extend downwardly into each leg. The recesses are sized to nestingly receive the legs of a grate of like construction placed in overlying relationship with the grate and have sidewalls which are joined to the sections of the support surface encircling the recesses along smooth arcuate surfaces so that the opening of each recess is devoid of sharp corners.

9 Claims, 2 Drawing Sheets

FIREPLACE GRATE

BACKGROUND OF THE INVENTION

This invention relates generally to fireplace accessories and relates more particularly to fireplace grates for supporting fireplace fuels in a spaced relationship with the floor of a fireplace.

Conventional fireplace grates include a rigid framework including a ribbed upper surface and legs for supporting the upper surface in a generally horizontal disposition with respect to the underlying fireplace floor. Due to their size, conventional grates are known to present problems relating to the warehousing or storage of large quantities of the grates. Fireplace grates can be manufactured with removable legs to thereby reduce the grate height for storage purposes and thereby relieve, to some extent, the storage-related problems attending the grates. The removable legs, however, are separate components which require special consideration when packing the grates for shipment and which require attachment to the remainder of the grate prior to use.

It would be desirable to provide a new and improved fireplace grate manufacturable as a single unit and which facilitates storage of a large quantity of similar grates in a relatively small amount of space.

Another object of the present invention is to provide such a grate possessing a construction which accommodates a casting of the grate as a single unit with a relatively small scrap rate.

Still another object of the present invention is to provide such a grate which is durable in construction and effective in operation.

SUMMARY OF THE INVENTION

This invention resides in a fireplace grate for supporting fireplace fuels above the floor of a fireplace.

The grate includes means defining a support surface upon which fireplace fuels are placed for burning and a plurality of legs for supporting the support surface above the fireplace floor. Each leg includes a body which is attached to the support surface-defining means. The support surface defines an upwardly-opening recess extending downwardly into the body of each leg for nestingly receiving the leg of a grate of like construction placed in overlying relationship therewith so that a plurality of grates of like construction can be stacked in a superposed relationship with the legs of each grate nestingly accepted by the legs of an underlying grate. In addition, the support surface has a section encircling the opening of each recess, and each recess has sidewalls which extend downwardly into the body of a corresponding leg and which are joined to a corresponding opening-encircling section along a smooth arcuate surface so that the opening of each recess is devoid of sharp corners.

DETAILED DESCRIPTION OF AN ILLUSTRATIVE EMBODIMENT

Figure 1:
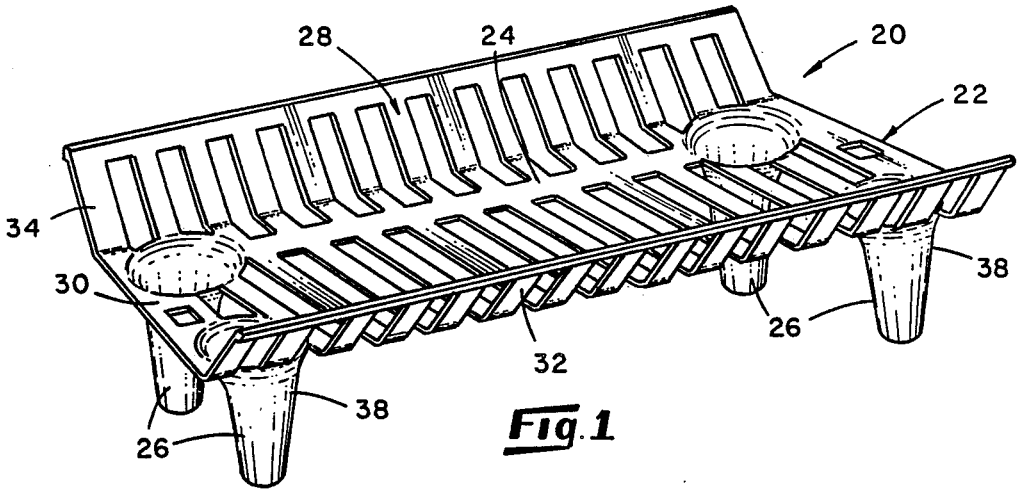
FIG. 1 is a perspective view of an embodiment of a fireplace grate.

Turning now to the drawings in greater detail, there is illustrated in FIG. 1 an embodiment, generally indicated 20, of a fireplace grate for supporting fireplace fuels, such as logs or kindling, above the floor of a fireplace. The grate 20 is preferably constructed of cast iron and includes means, indicated 22, defining a support surface 24 upon which the fireplace fuels are placed for burning and four legs 26 integrally joined to the support surface-defining means 22.

Figure 2:
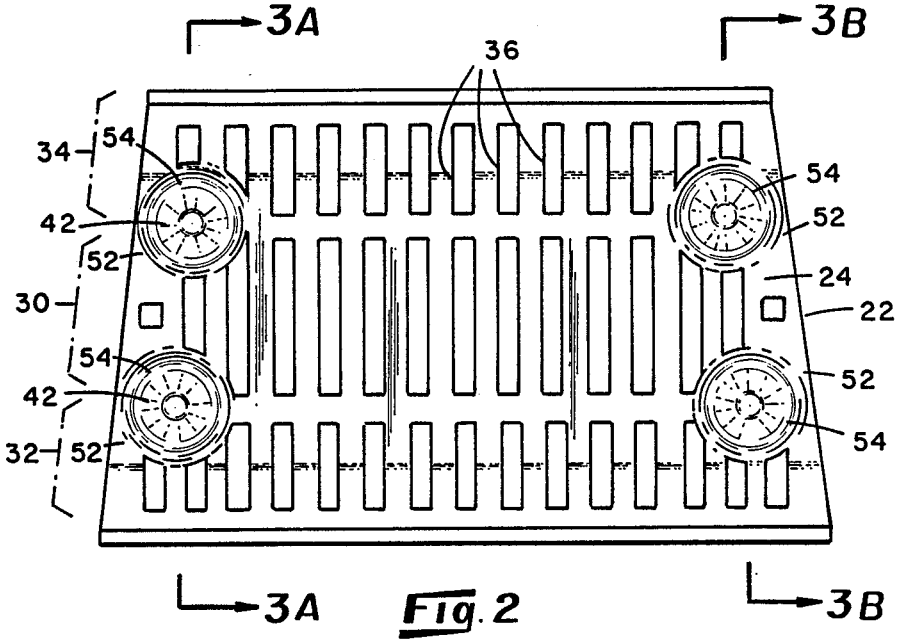
FIG. 2 is a top plan view of the grate of FIG. 1.
Figure 3:
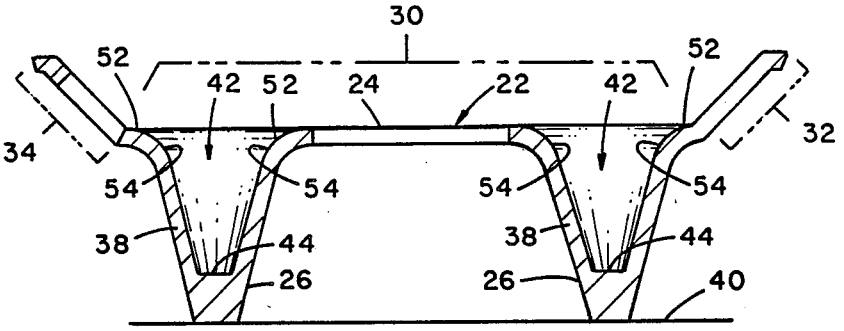
FIG. 3 is a cross-sectional view taken along either line 3A—3A or 3B—3B of FIG. 2.

The support surface-defining means 22 are in the form of an elongated frame 28 having a horizontally-disposed mid-portion 30 providing a planar upper surface and opposite forward and rearward portions 32, 34, respectively, which are joined to so as to extend angularly upwardly from the mid-portion 30 in the manner which is best shown in FIG. 3. The upper surfaces of each of the mid-portion, forward and rearward portions 30, 32, 33 collectively provide the support surface 24. In addition and with reference again to FIGS. 1 and 2, the frame 28 includes a plurality of ribs 36 suitably joined together so as to provide a number of elongated openings extending across the frame 28 in a front-to-back orientation. As fireplace fuels are burned upon the support surface 24, ashes are permitted to fall through the openings provided between the ribs 36 to the fireplace floor below.

With reference to FIG. 3, each leg 26 includes a body 38 which is integrally joined to so as to depend downwardly from the support surface-defining means 22 and maintain the support surface 24 in a spaced relationship with the underlying fireplace floor 40. It is a feature of the grate 20 that the support surface 24 includes a plurality of upwardly-opening recesses 42 which extend downwardly into the body of each leg so as to provide each leg body 38 with a hollow interior which is accessible through the support surface 24. Each recess 42 has a circular opening and sidewalls which extend downwardly into the body 38 of its corresponding leg 26 which are shaped so that the diameter of the recess decreases in size as a path is traced from the upper surface of the mid-portion 30 to the bottom, indicated 44, of the recess 42. In addition, each leg body 38 defines an outer surface which is shaped generally complimentary to that of the recess 42 extending into its body 38. More specifically, the outer surface of each leg body 38 is frusto-conical in shape.

Figure 4:
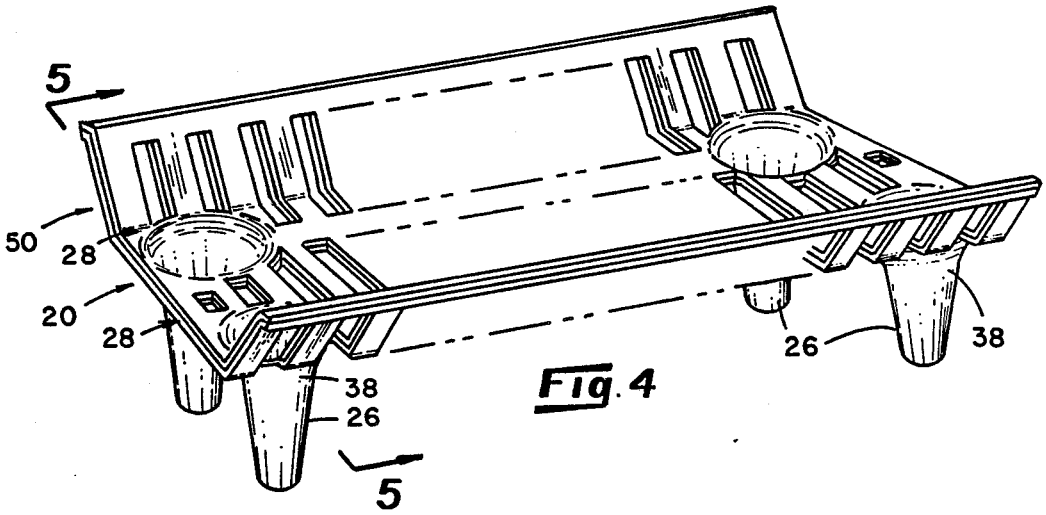
FIG. 4 is a perspective view of the grate of FIG. 1 and a grate of like construction when stacked upon the FIG. 1 grate.
Figure 5:
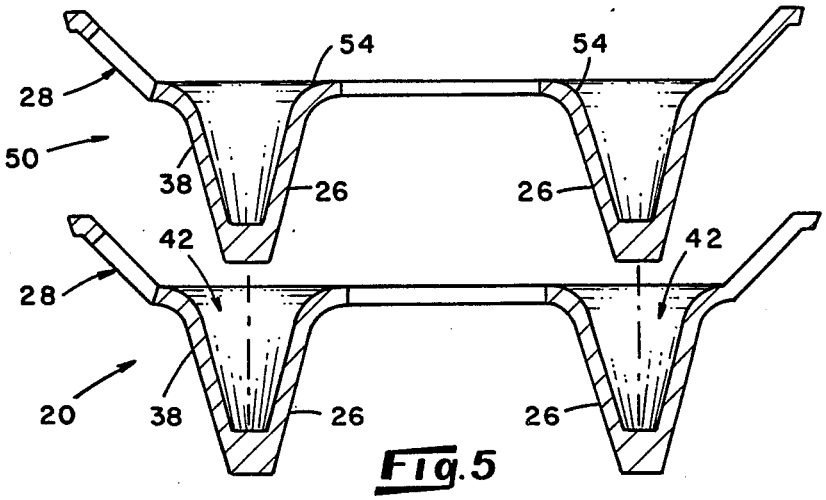
FIG. 5 is a cross-sectional view taken on line 5—5 of FIG. 4 illustrating the grates when positioned in a spaced condition.

It is another feature of the present invention that each recess 42 is sized and shaped to nestingly receive a grate of like construction to accommodate of stacking of the grates of like construction in a superposed relationship. For example, there is illustrated in FIGS. 4 and 5 a grate, indicated 50, which has been placed in superposed relationship above the grate 20 of FIGS. 1—3. The grate 50 is identical in construction to that of the grate 20 and, accordingly, its legs and frame bear the same reference numerals. The recesses 42 of grate 20 are sized so that when grate 50 is positioned above the grate 20 in the manner illustrated in FIG. with its legs 26 aligned with the underlying grate recesses 42, the frame 28 of the grate 50 can be lowered upon the frame 28 of the grate 28 with the legs 26 of the grate 50 being accepted by the recesses 42 of the grate 20. With the recesses 42 accepting the legs of the superposed grate 50 in the manner illustrated in FIG. 4, the resulting arrangement is relatively compact. It follows that the capacity of the recesses 42 to nestingly accept the legs of a grate of like construction permits a plurality of grates to be stacked in a manner requiring a relatively small amount of space.

With reference again to FIG. 3, it is another feature of the grate 20 that the opening of each recess 42 is devoid of sharp corners. To this end, each recess opening is encircled by a section, indicated 52 in FIG. 2, of the support surface 24 and the sidewalls of each recess 42 are joined to its corresponding encircling section 52 along a smooth arcuate transition surface 54. The transition surface 54 provides the opening of its corresponding recess 42 with a bell-shaped passageway which aids in the funneling of a leg of a superposed grate into the recess 42 and thereby facilitates the stacking of the grates.

Another advantage provided by the smooth arcuate transition surface 54 relates to the casting process involved in making the preferred cast iron form of the grate 20. In this connection, it has been found that upon casting grates having leg-receiving recesses whose sidewalls terminate at an upper support surface along a sharp corner, the corner is likely to break off thus requiring that the casted grate be scraped. In contrast, the smooth transition surface 54 of the grate 20 is devoid of any sharp corner, and it has been found that when compared to the scrap rate of grates whose leg-receiving recesses terminate in sharp corners, the scrap rate of grates possessing leg-receiving recesses whose opening is provided by a smooth transition surface 54 is significantly smaller.

It will be understood that numerous modifications and substitutions can be had to the aforedescribed embodiment without departing from the spirit of the invention. For example, although the aforedescribed embodiment 20 has been shown and described as including legs of round cross section, a grate in accordance with the broader aspects of this invention may include legs of alternative shapes, such as a shape providing a square cross section. In a square-legged embodiment, the leg-receiving recess opening downwardly into each leg of the grate may possess a square cross section. Accordingly, the aforedescribed embodiment 20 is intended for the purpose of illustration and not as limitation.

What is claimed is:

1. A fireplace grate comprising:

means defining a support surface upon which fireplace fuels are placed for burning; and a plurality of legs for supporting said support surface-defining means above a floor of a fireplace, each of said legs having a body which is attached to said support surface-defining means;

said support surface defining an upwardly-opening recess extending downwardly into the body of each leg for nestingly receiving the leg of a grate of like construction placed in overlying relationship with said grate so that a plurality of grates of like construction can be stacked in a superposed relationship with the legs of each grate nestingly accepted by the recesses of an underlying grate;

said support surface including a section encircling the opening of each recess; and each recess having sidewalls which extend downwardly into the body of a corresponding leg and which are joined to a corresponding opening-encircling section of said support surface along a smooth arcuate surface.

2. A fireplace grate as defined in claim 1 wherein each smooth arcuate surface is rounded in shape as a path is traced from the top of its corresponding recess toward the recess bottom.

3. A fireplace grate as defined in claim 1 wherein the arcuate surface joining of the recess sidewalls to the corresponding opening-encircling section is devoid of sharp corners.

4. The fireplace grate as defined in claim 1 wherein the body of each leg defines an outer surface and the outer surface of each leg body is shaped complimentary to the shape of the recess sidewalls extending downwardly therein.

5. A fireplace grate for supporting fireplace fuels above the floor of a fireplace, said grate comprising:

means defining a generally upwardly-facing support surface upon which fireplace fuels are placed for burning;

a plurality of legs for supporting said support surface-defining means above a fireplace floor, each of said legs including a body which is integrally attached to so as to depend downwardly from said support surface-defining means;

said support surface including an upwardly-opening recess extending downwardly into the body of each leg so as to provide each leg with a hollow interior cavity for nestingly receiving the leg of a grate of like construction placed in overlying relationship with said grate so that a plurality of grates of like construction can be stacked in a superposed relationship with the recesses of each grate nestingly receiving the legs of an overlying grate;

said support surface having a section encircling the opening of each recess; and each recess having sidewalls which extend downwardly into the body of a corresponding leg and are joined to a corresponding opening-encircling section of said support surface along a smooth arcuate surface so that the opening of each recess is devoid of sharp corners.

6. A fireplace grate as defined in claim 5 wherein the body of each leg has an outer surface which is circular in horizontal cross section and each recess is circular in horizontal cross section for encircling a leg of a grate of like construction.

7. A fireplace grate as defined in claim 5 wherein each smooth arcuate surface is rounded in shape as a path is traced from the top of its corresponding recess toward the recess bottom.

8. The fireplace grate as defined in claim 5 wherein the body of each leg defines an outer surface and the outer surface of each leg body is shaped complimentary to the shape of the recess sidewalls extending downwardly therein.

9. A fireplace grate for supporting fireplace fuels above the floor of a fireplace, said grate comprising:

a frame including a plurality of spaced ribs arranged so as to collectively define a support surface upon which fireplace fuels are placed for burning and so that the spacing provided between adjacent ribs accommodates the dropping of ashes through the support surface to the fireplace floor;

a plurality of legs for supporting said frame above the fireplace floor, each leg having a generally frustoconically-shaped body integrally joined to said frame so that the smaller end of said leg body depends downwardly from said frame;

said support surface defining an upwardly-opening recess of circular cross section, when said cross section is viewed in a horizontal plane, for nestingly receiving the leg of a grate of like construction placed in overlying relationship with said grate so that a plurality of grates of like construction can be stacked in a superposed relationship with the legs of each grate nestingly accepted by the recess of an underlying grate;

said upper surface including a section encircling the opening of each recess; and each recess having sidewalls which extend downwardly into the body of a corresponding leg and which are joined to a corresponding opening-encircling section of said support surface along a smooth surface which is rounded in shape as a path is traced downwardly into the recess from the opening-encircling section.

* * * * *